US006029318A

United States Patent [19]

Dinkelmann

[11] Patent Number: 6,029,318

[45] Date of Patent: Feb. 29, 2000

[54] DRAFTING FRAME FOR A SPINNING MACHINE

[75] Inventor: Friedrich Dinkelmann, Rechberghausen, Germany

[73] Assignee: Zinser Textilmaschinen GmbH, Ebersbach/Fils, Germany

[21] Appl. No.: 09/211,932

[22] Filed: Dec. 15, 1998

[30] Foreign Application Priority Data

Dec. 18, 1997 [DE] Germany ..... 197 56 393

[51] Int. Cl.[7] ..... D01H 5/86; D01H 5/70; D01H 5/56

[52] U.S. Cl. ..... 19/244; 19/246

[58] Field of Search ..... 19/134, 244, 246, 19/260–266; 57/328

[56] References Cited

U.S. PATENT DOCUMENTS

| | | | |
|---|---|---|---|
| 2,470,055 | 5/1949 | Schlums | 19/246 |
| 3,006,036 | 10/1961 | Schrotz | 19/134 |
| 3,105,998 | 10/1963 | Raboisson | 19/244 |
| 4,644,609 | 2/1987 | Lattner | 19/244 |
| 5,551,225 | 9/1996 | Maruki | 57/328 |
| 5,600,872 | 2/1997 | Artzt | 19/244 |

FOREIGN PATENT DOCUMENTS 43 23 472 1/1995 Germany .

*Primary Examiner*—John J. Calvert
*Assistant Examiner*—Mary K. Fiore
*Attorney, Agent, or Firm*—Herbert Dubno

[57] ABSTRACT

A drafting frame for a spinning machine has a compaction unit at the downstream end of the drafting path which can be removed and other rollers and belts of the upper and lower arrays can be advanced as required to maintain the length of the paths of the sliver.

7 Claims, 3 Drawing Sheets

FIG. 1
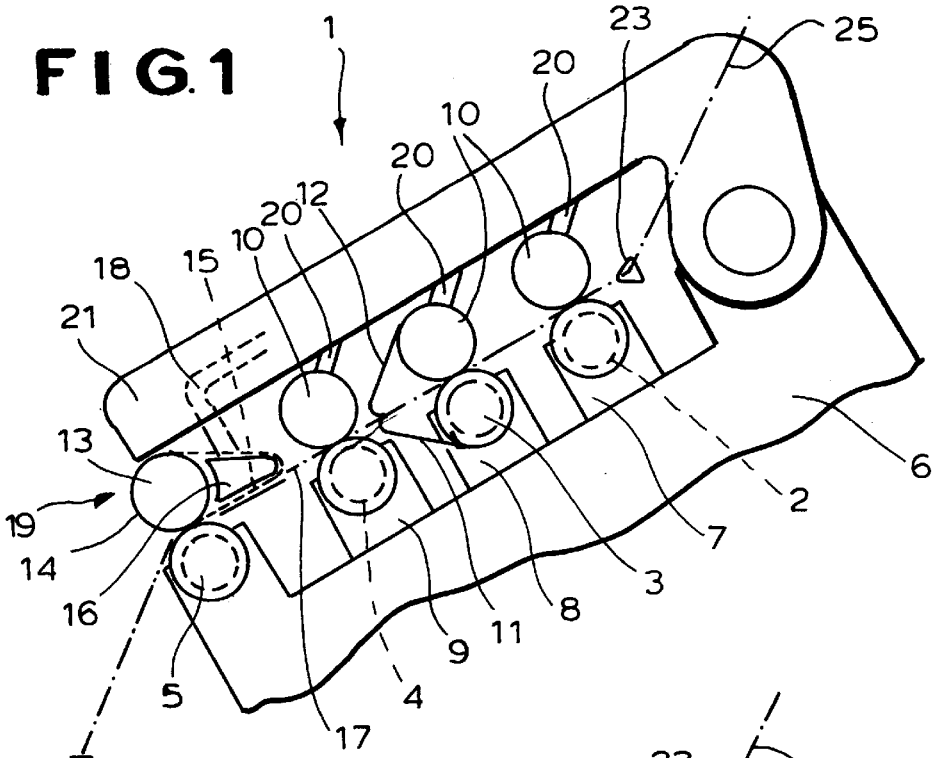
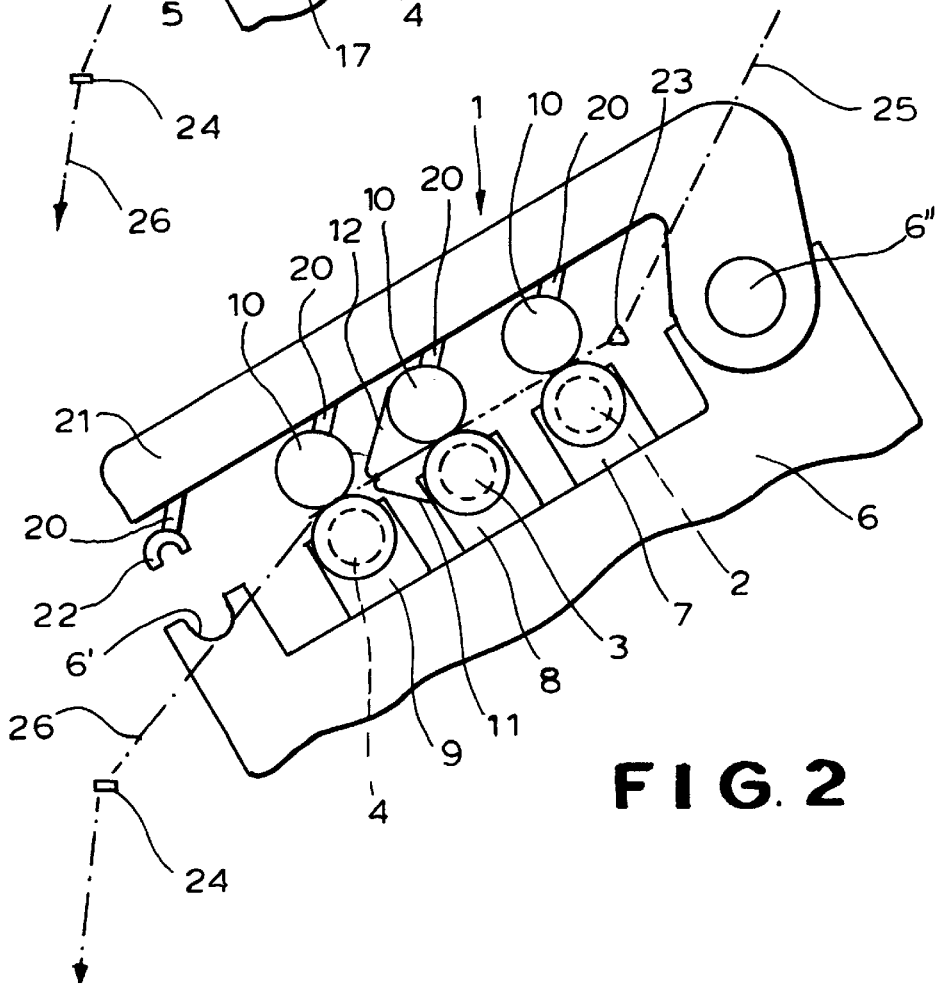
FIG. 2

FIG. 3
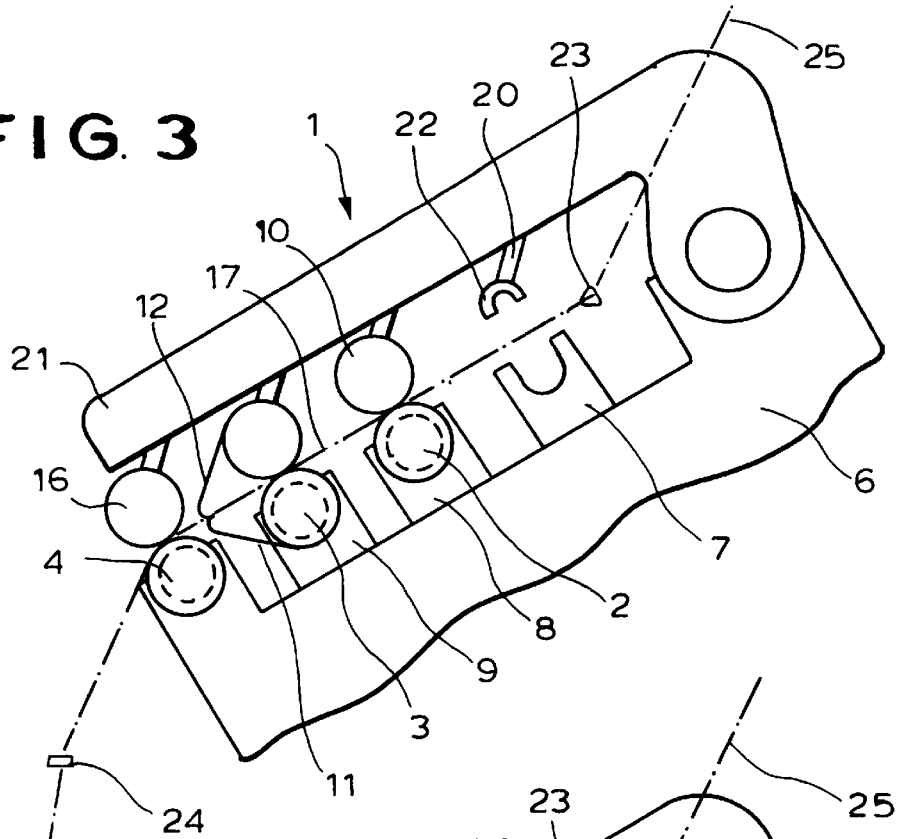
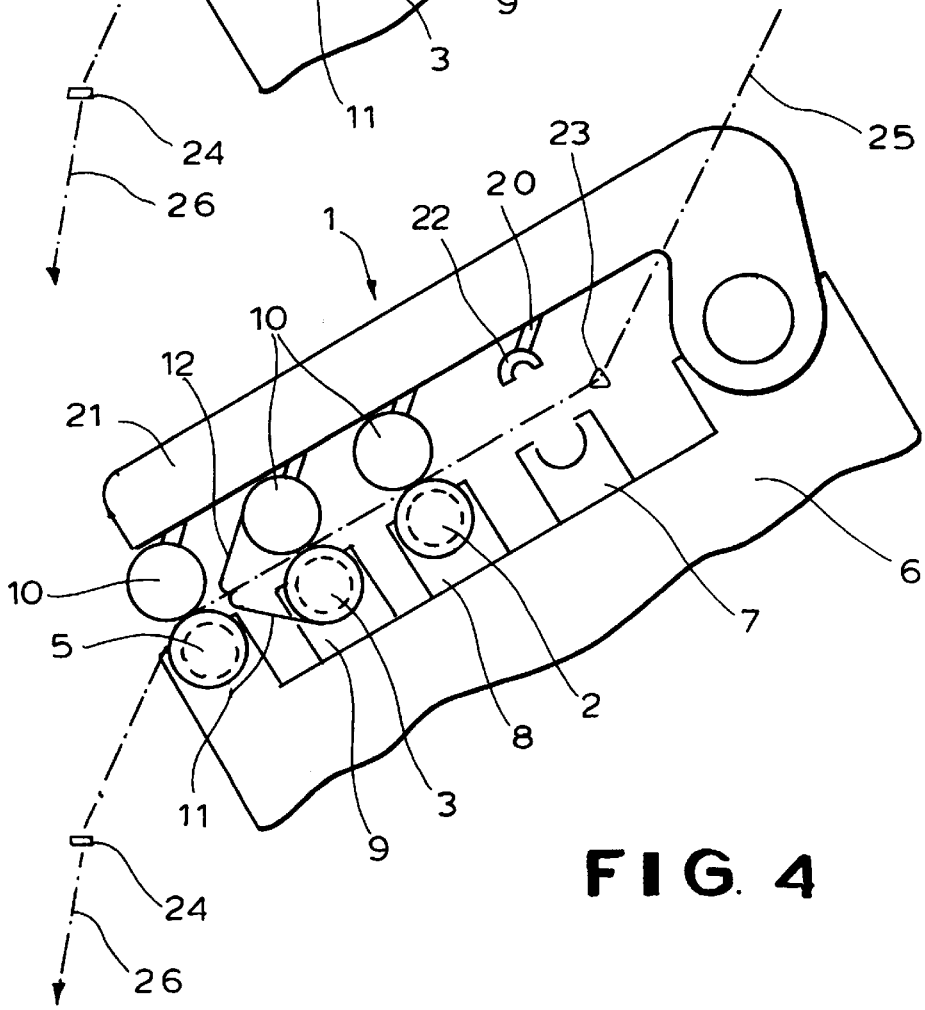
FIG. 4

FIG. 6
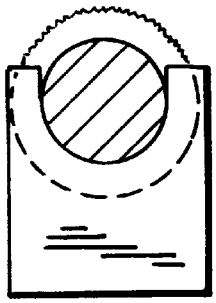
FIG. 5
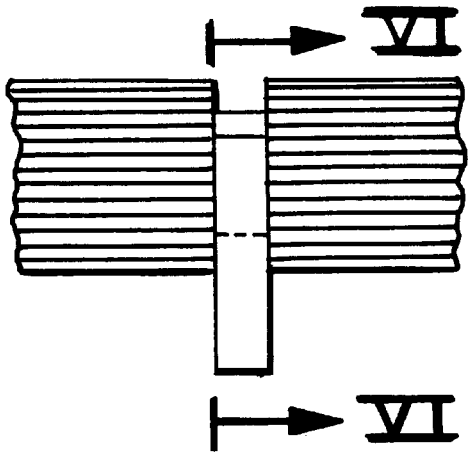
FIG. 8
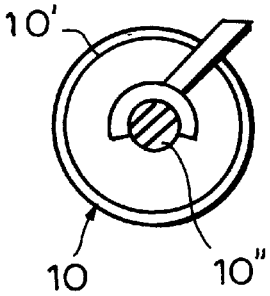
FIG. 7
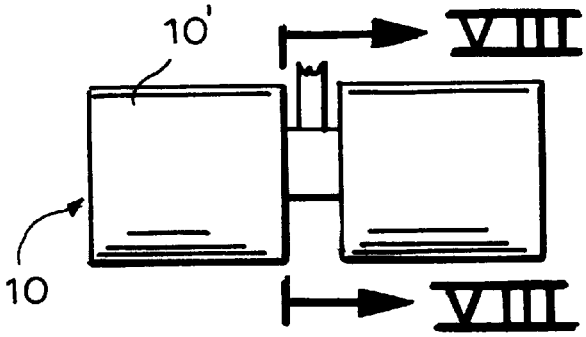
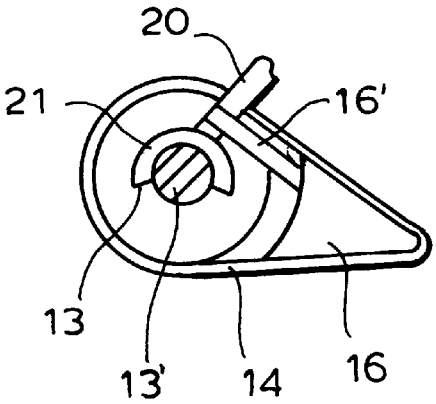
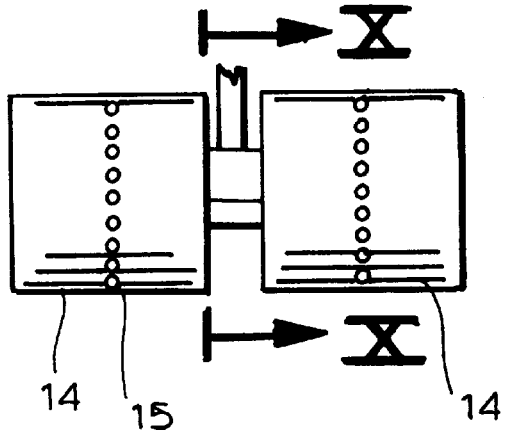
FIG. 10
FIG. 9

DRAFTING FRAME FOR A SPINNING MACHINE

FIELD OF THE INVENTION

My present invention relates to a drafting frame for a spinning machine and, more particularly, to a drafting frame of the type which comprises an array of upper rollers and/or belts, mounted on a pressing arm and lower rollers and/or belts supported beneath the pressing arm and between which a sliver is guided for drafting sliver and, customarily including means for compacting the sliver.

BACKGROUND OF THE INVENTION

Drafting frames of the aforedescribed type are intended to draw out and increase the fineness of the sliver prior to feeding the same to the spindles of a roving frame and, where the drafting frame is of the type described for example in German patent document 43 23 472 C2, the drafting frame may have at the output side for each strand, a sliver-compaction unit which generates a lateral compaction of the sliver before it is supplied to the ring or traveler or spindle unit for spinning. The result is a so-called compaction spinning of the textile strand.

For such compaction spinning, a variety of devices have been proposed. For example, the compaction unit may operate pneumatically, i.e. with a compaction belt associated with the upper and/or lower array of rollers or belts and which is formed with an row of holes extending in the direction of travel of the textile strand, i.e. the sliver, and communicating with a chamber to which suction is applied. A belt of the type can be provided in conjunction with a roller as the final compaction stage of the drafting path or in combination with another similar belt.

Whichever approach is used, the row of holes should be provided at least in the belt associated with an upper roller.

Under certain circumstances, it is desirable to dispense with the compaction function of the drafting frame. This cannot be done simply by cutting off the suction to the compaction unit at the output end of the path of the sliver through the drafting frame because the mere presence of the compaction unit contributes to a compaction in the final stage of drafting. It has been found to be problematical to simply replace the compaction unit by a simple roller because in that case, there is insufficient guidance of the sliver and experience has shown that the quality of the thread or yarn which is produced is detrimentally affected.

OBJECTS OF THE INVENTION

It is the principal object of the present invention to provide an improved drafting system which allows compaction spinning with a drafting unit at the output end of the roller assembly of a drafting frame and upstream of a ring, traveller or spindle spinning machine, but where desirable, can permit drafting without compaction and without the drawbacks of earlier systems as detailed above.

It is another object of the invention to provide an improved drafting machine for a spinning frame, e.g. a roving frame of the ring/traveller/spindle type which provides significant advantages over earlier drafting frames for this purpose.

SUMMARY OF THE INVENTION

These objects and others which will become apparent hereinafter are attained, in accordance with the invention in a drafting frame for a spinning machine having upper and lower rollers and upper and lower belts along the path of a sliver, hereinafter referred to also as a textile strand or a fiber strand, whereby the drafting frame has a sliver-compaction unit at the output side of this path and which is removable when the path is to be stripped of its sliver-compaction function, the remaining rollers and belts of the path being displaceable shifting them each in succession through one position toward the outlet end. Conversely, when the drafting frame is to be restored to its capacity for sliver compaction, the pairs of rollers and belts are stepped back along the respective path and the compaction unit is reinstalled at the outlet side of the path.

The system of the invention thus has an advantage that by replacing the compaction unit at the outlet end with a preceding roller or belt arrangement normally present along the path when the compaction unit is provided, enables operation of the drafting frame with precise guidance and control of the drafted strand, especially with respect to travel of the strand to the spinning operation.

In case the output roller path of the drafting frame is associated with a shutdown suction device or a thread break shutdown device with the system of the invention, the drafting frame can retain the functions of these units without structural modification.

It has been found to be especially advantageous and simple to change the positions of the rollers of the drafting frame when the journals of the lower rollers and the holders of the upper rollers are formed identically for the respective arrays so that the rollers and belts along each array can be shifted from position to position along each array without difficulty. It has also been found to be advantageous to provide the lower rollers of the drafting path of approximately equal diameters since their peripheries can, in accordance with the present invention, lie at least approximately at the same height and define a plane for the travel of the sliver in all positions of the lower rollers.

More specifically, a drafting frame for a spinning machine cam comprise for each sliver-drafting path of the drafting frame:

a lower array of lower rollers and belts spaced apart along the lower array;

a pressing arm overlying the lower array of lower rollers and belts and carrying an upper array of rollers and belts juxtaposed with the lower rollers and belts and engaging a sliver along the path between the upper and lower arrays;

a sliver-compaction unit at a downstream end of the path in the upper array juxtaposed with an output roller of the lower array for compacting drafted sliver between them, at least the unit being removable from the arm;

respective seats along the lower array for detachably receiving the lower rollers and belts;

holders on the arm for detachable engagement with the unit and the upper rollers and belts whereby, upon removal of the unit, the upper rollers and belts are shiftable along the upper array for operation of the drafting frame without a sliver-compaction function.

BRIEF DESCRIPTION OF THE DRAWING

The above and other objects, features, and advantages will become more readily apparent from the following description, reference being made to the accompanying drawing in which:

FIG. 1 is a side elevational view of a drafting frame showing one pressing arm and the upper and lower rollers and belts associated therewith for feeding, for example, two spinning stations of the subsequent ring, traveller or spindle spinning machine for forming the roving frame drafted sliver;

FIG. 2 is a view similar to FIG. 1 showing the compaction unit at the output end of the drafting path removed, i.e. with the drafting path stripped of its compaction function;

FIG. 3 is a view similar to FIG. 1 showing the repositioning of the remaining units of the drafting path for drafting free form the compaction stage;

FIG. 4 is a view similar to FIG. 1 illustrating an alternative;

FIG. 5 is a front view of the lower roller of the output roller assembly of FIG. 3 with the drafting frame being operated for compaction-less spinning;

FIG. 6 is a cross sectional view taken along the line VI—VI of FIG. 5;

FIG. 7 is a view similar to FIG. 5 of the upper roller of the output roller assembly of FIG. 3;

FIG. 8 is a cross sectional view taken along the line VIII—VIII of FIG. 7;

FIG. 9 is a front view upper belt arrangement of the compaction unit of FIG. 1; and FIG. 10 is a cross sectional view taken along the line X—X of FIG. 9.

SPECIFIC DESCRIPTION

As can be seen from FIG. 1, the drafting frame for a ring-spinning machine, for example, transforming a sliver into a roving, can comprise arrays of upper and lower rollers for each of a number of sliver-drafting paths and, at least for the lower array of rollers the rollers can extend over all or part of the length of the drafting frame and over all or part of the length of the spinning machine. It is possible to provide rollers separately for each path, however, and the present invention is applicable to arrangements wherein the lower rollers extend the full or part of the length of the spinning machine and drafting frame as well as to arrangements in which the lower rollers can be shorter. In either case, the lower roller array comprises, as a rule, four milled lower rollers 2, 3, 4 and 5, the lower roller 3 being usually cross-milled or knurled and being encircled by a lower belt 11 guided over a bar or rail (not shown) and juxtaposed with an upper belt 12.

The output lower roller 5 can be mounted in a seat 6' formed directly in the stand 6 supporting the lower rollers and providing a pivot 6" for the upper arms 21. The lower rollers 2, 3, 4 are received in slides 7, 8, 9, forming similar seats but which are shiftable on the stand 6 and being adapted to be fixed in place thereon. The direction of adjustment is the direction of travel of the sliver.

The seats for the lower rollers are identical so that any of the lower rollers can be received in any of the seats. The lower rollers 2, 3, 4 all are approximately of the same diameter so that the strand lies substantially in a drafting plane as it passes over these rollers.

The lower rollers 2 and 4 are juxtaposed with normal upper rollers 10 which have, s shown in FIG. 8, elastic coverings 10' thereon. The upper roller 10 juxtaposed with the lower roller 3, is encircled by the upper belt 12 which is guided over a direction-changing rail (not shown) with the usual belt cage (not shown). The lower output roller 5 is juxtaposed with an upper roller 13 which also is encircled by an upper belt 14 and forms the pressing unit 19 therewith. The upper belt 14 is provided with a row of holes 15 (see also FIG. 9) which lies at the center of the belt and extends all around the periphery thereof. Within the upper belt a chamber 16 is formed which can be held at 16' on the arm 20 supporting the pressing unit. The chamber 16 is open toward the lower pass of the belt 14 which engages the sliver 17 or is provided with a perforation which communicates with the apertures 15 to apply suction therethrough to the sliver suction is applied to the chamber 16 via a suction tube 18, connected to a suction source such as a suction pump (not shown). The upper roller 13, the upper belt 14 and the chamber 16 collectively form the compaction unit 19.

As shown in FIGS. 7 and 9, the upper rollers 10 and 13 form roller pairs which are carried by the arms 20 and the holders 22 into which the shaft 13' or 10" of the roller pair can be snapped. The holders 22 are identical so that the upper rollers and the belt assemblies of the upper array can be snapped into one or the other of the positions along the array. The holders 22 and the arms 20 are connected to the loading arm 21 which is swingable on the pivot 6" and is weighted to apply the requisite force of the upper rollers and belts of the sliver supported on the lower rollers and belts.

The drafting path also includes a sliver or roving guide 23 and a thread guide 24, the latter being immediately upstream of the ring/traveller, spindle unit forming the spinning machine. The sliver at 25 is passed through the nip of an input roller pair 2, 10, then between the upper and lower pair of belts 11, 12, and then past the roller pair 4, 10 with the stretched sliver 17 at its final fineness being supplied to the compaction unit 19 which compacts the sliver against the lower roller 5. During the drafting the sliver 17 runs in its width but is drawn together by the suction through the row of holes 15 in the upper belt 14 of the compaction unit. The reduced thread 26 passes via the thread guide to the spinning unit.

When the compaction function is to be eliminated, the unit 19 can be snapped out of the holder 22 and the output end of the lower roller 5 removed. This is shown in FIG. 2. It will be apparent that this changes the length of the path of the thread 26 from the thread guide 24 to the last roller path. With sensitive threads or yarns this can have a detrimental effect on thread quality. The suction device usually provided for the output roller 5 or a thread break shutdown unit which may normally be provided must be removed or shifted in location.

To avoid this the invention provides that the rollers 2, 3 and 4 are shifted to the seats 8, 9 and 6' as has been shown in FIG. 3. The lower roller 4 is provided in the seat 6', the lower roller 3 in the seat 9 and the lower roller 2 in the seat 3. Similarly, the upper rollers and the belt 12 are shifted each by one holder 22 toward the output side (FIG. 3).

FIG. 3 therefore shows the new positions of the upper and lower rollers and a roller pair 4/10 at the output side maintains the distance between the point at which the thread leaves the drafting frame and the guide 24. The angle of the yarn is also the same. Indeed, even the supply path of the roving remains the same.

FIG. 4 shows an embodiment of the invention where the roller 5 remains in place but roller 4 is removed and the other rollers and belts are shifted as has been described above. The result is the layout seen in FIG. 4. For resetting of the drafting frame for the compaction function, the rollers and belts are shifted in the opposite directions to their original holders and seats and the compaction unit 19 is reinserted as is the lower roller 5 or 4 as the case may be.

It will be apparent that conventional drafting frames can be equipped with the system of the invention, i.e. retrofitted, readily.

I claim:

1. A drafting frame for spinning machines, said drafting frame comprising for each sliver-drafting path:

a lower array of lower rollers and belts spaced apart along said lower array;

a pressing arm overlying said lower array of lower rollers and belts and carrying an upper array of rollers and belts juxtaposed with the lower rollers and belts and engaging a sliver along said path between said upper and lower arrays;

a sliver-compaction unit at a downstream end of said path in said upper array juxtaposed with an output roller of said lower array for compacting drafted sliver between them, at least said unit being removable from said arm;

respective seats along said lower array for detachably receiving said lower rollers and belts;

holding means on said arm for detachable engagement with said unit and said upper rollers and belts whereby, upon removal of said unit, said upper rollers and belts are shiftable and for shifting said upper rollers and belts along said upper array for operation of the drafting frame without a sliver-compaction function.

2. The drafting frame as defined in claim 1 wherein the seats along said lower array are identical to one another to interchangeably receive said lower rollers and belts.

3. The drafting frame as defined in claim 1 wherein the diameters of said lower rollers are approximately equal.

4. The drafting frame as defined in claim 1 wherein an output of one of said lower rollers juxtaposed with said sliver compaction unit is removable along with said sliver compaction unit and is replaceable by a lower roller upstream therefrom.

5. The drafting frame as defined in claim 1 wherein, upon removal of said sliver compaction unit, each of the upper rollers and belts are stepped by one location along said holding means on said arm.

6. The drafting frame as defined in claim 1 wherein, upon removal of said sliver compaction unit, the lower roller immediately upstream from said output roller is removed and remaining lower rollers are stepped toward said output roller.

7. The drafting frame as defined in claim 1 wherein said sliver compaction unit has the function of the upper roller.

* * * * *